US010342306B2

(12) United States Patent
Chen

(10) Patent No.: US 10,342,306 B2
(45) Date of Patent: Jul. 9, 2019

(54) FLOW-GUIDING DEVICE AND UMBRELLA HAVING THE SAME

(71) Applicant: Huai Chen, Paramus, NJ (US)

(72) Inventor: Huai Chen, Paramus, NJ (US)

(73) Assignee: HUAI CHEN, Paramus, NJ (US)

( * ) Notice: Subject to any disclaimer, the term of this patent is extended or adjusted under 35 U.S.C. 154(b) by 0 days.

(21) Appl. No.: 15/884,746

(22) Filed: Jan. 31, 2018

(65) Prior Publication Data

US 2018/0235331 A1 Aug. 23, 2018

(30) Foreign Application Priority Data

Feb. 22, 2017 (TW) ..... 106105903 A

(51) Int. Cl.
*A45B 25/28* (2006.01)

(52) U.S. Cl.
CPC ..... *A45B 25/28* (2013.01)

(58) Field of Classification Search
CPC ..... A45B 25/28
USPC ..... 4/144.1
See application file for complete search history.

(56) References Cited

U.S. PATENT DOCUMENTS 5,385,162 A * 1/1995 Wu ..... A45B 25/24 135/34.2
5,669,402 A * 9/1997 Sun ..... A45B 25/28 135/33.2
8,069,500 B2 * 12/2011 Seskin ..... A63B 57/00 4/144.1
8,336,566 B2 * 12/2012 Jarrett ..... A45B 25/28 135/33.2

FOREIGN PATENT DOCUMENTS

FR 1446418 A * 7/1966 ..... A45B 25/28
GB 191204229 A * 9/1912 ..... A45B 25/28

* cited by examiner

*Primary Examiner* — Noah Chandler Hawk
(74) *Attorney, Agent, or Firm* — Locke Lord LLP; Tim Tingkang Xia, Esq.

(57) ABSTRACT

The present invention provides a flow-guiding device, comprising: a flow-guiding passage, a plurality of a first control valves, a flow-guiding bag and a flow-guiding tube. One end of the flow-guiding passage is connected to a flow-guiding opening and the other end of the flow-guiding passage is connected to a plurality of first control valves.
The plurality of first control valves are further connected to the flow-guiding bag, which is connected to one end of the flow-guiding tube. By opening the plurality of first control valves, the fluid coming down from the flow-guiding opening is directed to flow into the flow-guiding bag, and by closing the plurality of first control valves. The other end of the flow-guiding tube is connected to a second control valve; by opening the second control valve, the fluid inside the flow-guiding bag is discharged. The present invention also provides an umbrella having a flow-guiding device.

6 Claims, 5 Drawing Sheets

FLOW-GUIDING DEVICE AND UMBRELLA HAVING THE SAME

CROSS-REFERENCE TO RELATED APPLICATION

This application claims the benefit of Taiwan Patent Application No. 106105903, filed on Feb. 22, 2017, in the Taiwan Intellectual Property Office, the disclosure of which is incorporated herein in its entirety by reference.

BACKGROUND OF THE INVENTION

Field Of The Invention

The present invention relates to a flow-guiding device and an umbrella having a flow-guiding device; more particularly, the present invention relates to a flow-guiding device that men can use for urination, and an umbrella having said flow-guiding device.

Description Of The Prior Art

Urination is a biological need; however, it happens that when one travels outside, it is inconvenient to answer the call of nature. There are also times that one needs to work for long hours and stay outdoors, and a restroom is hard to find; one would then have to hold in urine till a restroom is available. Due to biological differences between men and women, it is easier for men than women to urinate in a public place, and thus, a type of simple urine bag has been developed that has a bag body and an opening. A man can urinate toward the bag opening and then close the opening with a string. Therefore, when a man needs to urinate, he can find a place that provides concealment and use the simple urine bag for urination. However, such simple urine bags have their drawbacks: as the bag opening is closed only with a string instead of being sealed completely, urine is likely to leak from an interstice of the bag and poses a sanitary hazard. Moreover, using a urine bag would require a more private spot.

Hence, to design an easy-to-use product that allows users to avoid suppressing the urge to urinate without creating sanitary concerns remains a challenge to be addressed in the related field.

SUMMARY OF THE INVENTION

In view of the above-described problems with prior art, the present invention provides a flow-guiding device and an umbrella having a flow-guiding device, so that the umbrella can be utilized not only for shielding sun or rain, but also for covering a male body when urinating.

An object of the present invention is to provide a flow-guiding device and an umbrella with the flow-guiding device. With a design that integrates a flow-guiding device on the structure of an umbrella, the invention, by providing a shielding function of an umbrella along with the features of a flow-guiding device, allows the user to urinate conveniently when a restroom is not available.

To achieve the above-described object, the present invention provides a flow-guiding device, comprising a flow-guiding passage, a plurality of first control valves, a flow-guiding bag and a flow-guiding tube. One end of the flow-guiding passage is connected to a flow-guiding opening, and the other end of the flow-guiding passage is connected to the plurality of first control valves; the plurality of first control valves are further connected to the flow-guiding bag, which is further connected to one end of the flow-guiding tube. By opening the plurality of first control valves, fluid coming down from the flow-guiding opening is directed to flow into the flow-guiding bag. By closing the plurality of first control valves, backflow of the fluid is prevented. The other end of the flow-guiding tube is connected to a second control valve. By opening the second control valve, the fluid inside the flow-guiding bag is discharged.

Preferably, the flow-guiding device of the present invention has a modular design and can be installed on any structure with a flow-guiding opening.

To achieve the above-described object, the present invention further provides an umbrella having a flow-guiding device, comprising: an umbrella shaft, having a handle disposed on one end and a second control valve disposed on the other end; an umbrella frame, having a plurality of ribs disposed pivotally around the umbrella shaft and extending outward radially; an umbrella cloth, covering the umbrella frame and having an outside surface and an inside surface, the outside surface having a flow-guiding opening arranged thereon; and a flow-guiding device, being disposed on the inside surface of the umbrella cloth between two adjacent ribs of the umbrella frame and comprising: a flow-guiding passage; a plurality of first control valves; a flow-guiding bag; and a flow-guiding tube, wherein: the flow-guiding passage is connected to the flow-guiding opening and the plurality of first control valves; the plurality of first control valves are connected to the flow-guiding bag, which is further connected to one end of the flow-guiding tube; by opening the plurality of first control valves, fluid coming down from the flow-guiding opening is directed to flow into the flow-guiding bag; by closing the plurality of first control valves, backflow of the fluid is prevented; the other end of the flow-guiding tube is connected to the second control valve on the umbrella shaft; and by opening the second control valve, the fluid inside the flow-guiding bag is discharged.

Preferably, the umbrella with a flow-guiding device according to the present invention further comprises a protective layer, which is used for covering the flow-guiding device, so as to protect and secure the flow-guiding device onto the inside surface of the umbrella cloth and to improve the outlook of the umbrella.

Preferably, the umbrella shaft is hollow, and the flow-guiding opening and the flow-guiding passage are formed in shapes that match shapes of human body parts.

Preferably, the flow-guiding opening and the flow-guiding passage are round or oval in shape.

Preferably, the flow-guiding bag has a tapering funnel shape that is wide at the top and narrow at the bottom.

Preferably, the plurality of first control valves are one-way check valves.

DETAILED DESCRIPTION OF THE PREFERRED EMBODIMENTS

The exemplary embodiments below are intended to help illustrate the invention, but not intended to limit the scope of the invention to the disclosed embodiments containing specific features, structures, or nature. The scope of the invention should, however, be determined with reference to the appended claims. Besides, the referenced drawings in the description do not illustrate features which may be unnecessary for understanding the present invention, and the elements are shown in a simplified, schematic view. Dimensions of the components may be enlarged or may be disproportionate to their actual sizes for the purpose of illustration. Regardless of the above-mentioned simplifications, or whether relevant features are illustrated comprehensively, it should be appreciated that the description contains the knowledge based on which various other embodiments of the invention with related features, structure or nature can be carried out by those skilled in the art.

Figure 1:
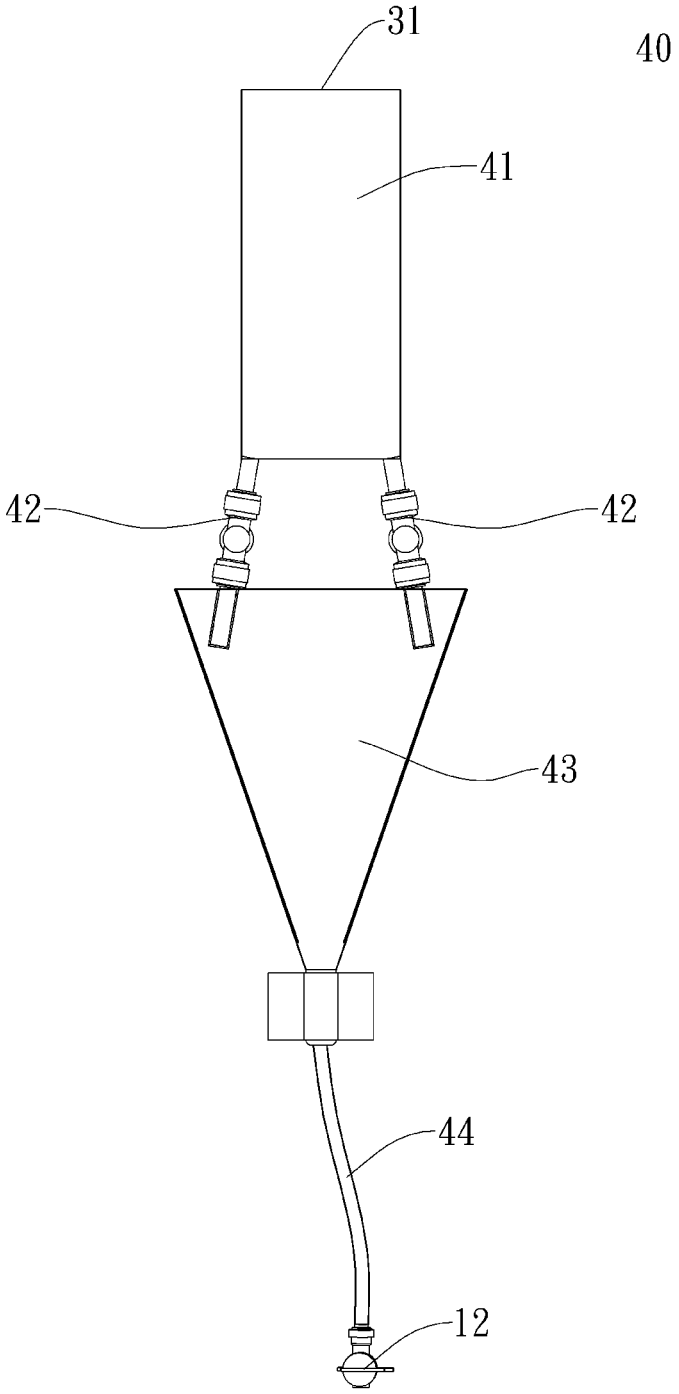
FIG. 1 is a schematic view illustrating a flow-guiding device according to the present invention.

FIG. 1 is a schematic view illustrating a flow-guiding device according to the present invention. The flow-guiding device 40 of the present invention comprises a flow-guiding passage 41, a plurality of first control valves 42, a flow-guiding bag 43 and a flow-guiding tube 44, wherein one end of the flow-guiding passage 41 is connected to a flow-guiding opening 31, the other end of the flow-guiding passage 41 is connected to the plurality of first control valves 42, the plurality of first control valves 42 are connected to the flow-guiding bag 43, and the flow-guiding bag 43 is further connected to one end of the flow-guiding tube 44. By opening the plurality of first control valves 42, the fluid coming down from the flow-guiding opening 31 is directed to flow into the flow-guiding bag 43, and by closing the plurality of first control valves 42, backflow of the fluid can be prevented. The other end of the flow-guiding tube 44 is connected to a second control valve 12; by opening the second control valve 12, the fluid inside the flow-guiding bag is discharged.

Continue with FIG. 1. In this embodiment, the flow-guiding bag of the flow-guiding device has a tapering funnel shape that is wide at the top and narrow at the bottom. The design facilitates quick collection of fluids. In this embodiment, the first control valves may be one-way check valves, which can prevent fluid backflow while the user needs not manually open or close them. Besides, the flow-guiding device of the present invention has a modular design and can be installed on any structure with a flow-guiding opening. By connecting the flow-guiding device of the present invention to a structure having a flow-guiding opening, the fluid that flows down from the flow-guiding opening can be collected conveniently and then discharged quickly.

Figure 2A:
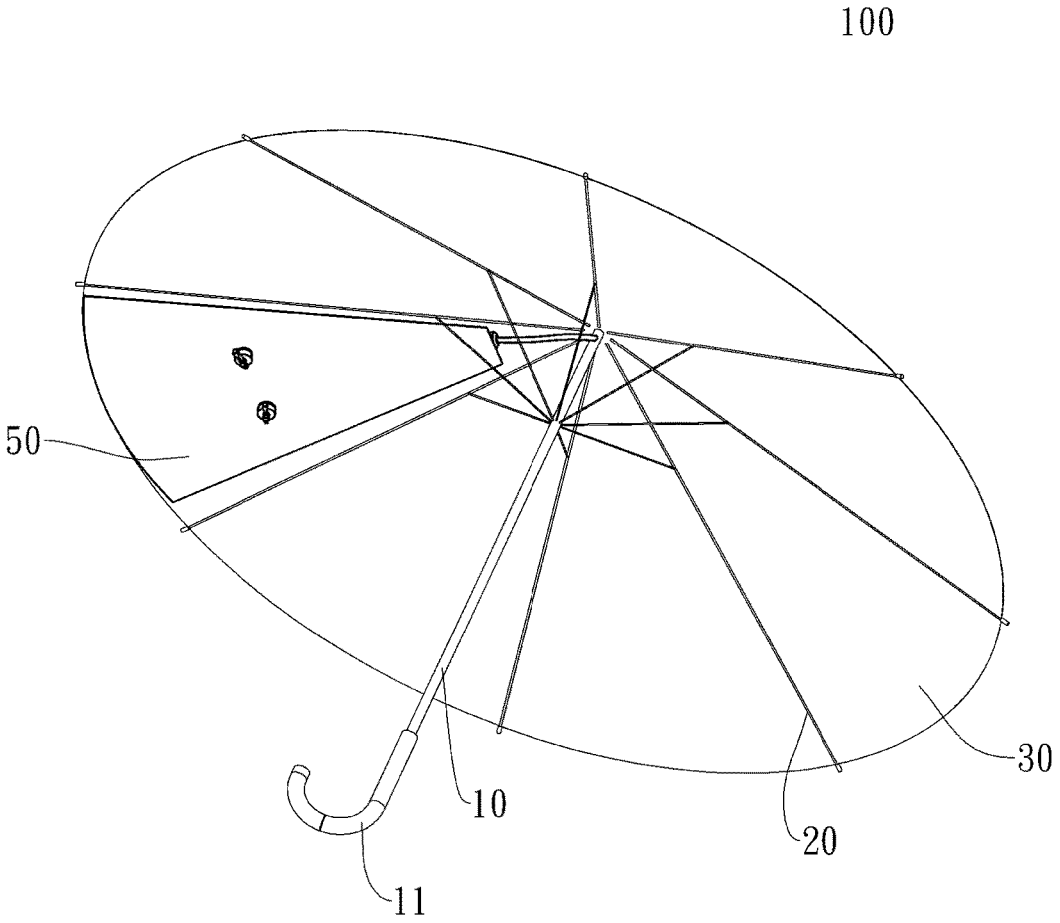
FIG. 2A is a perspective view illustrating an umbrella having a flow-guiding device according to the present invention.
Figure 2B:
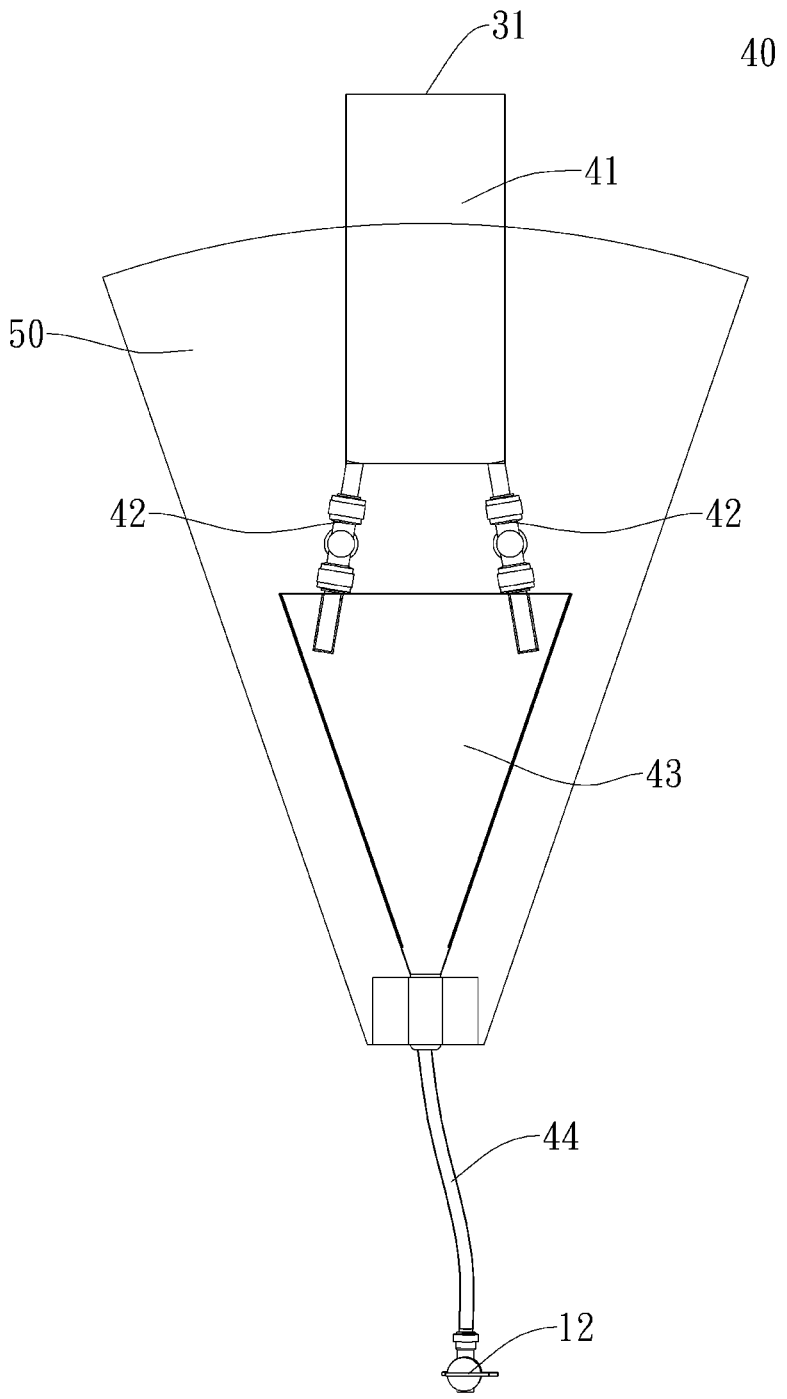
FIG. 2B is a schematic view showing the flow-guiding device of the umbrella according to the present invention.
Figure 2C:
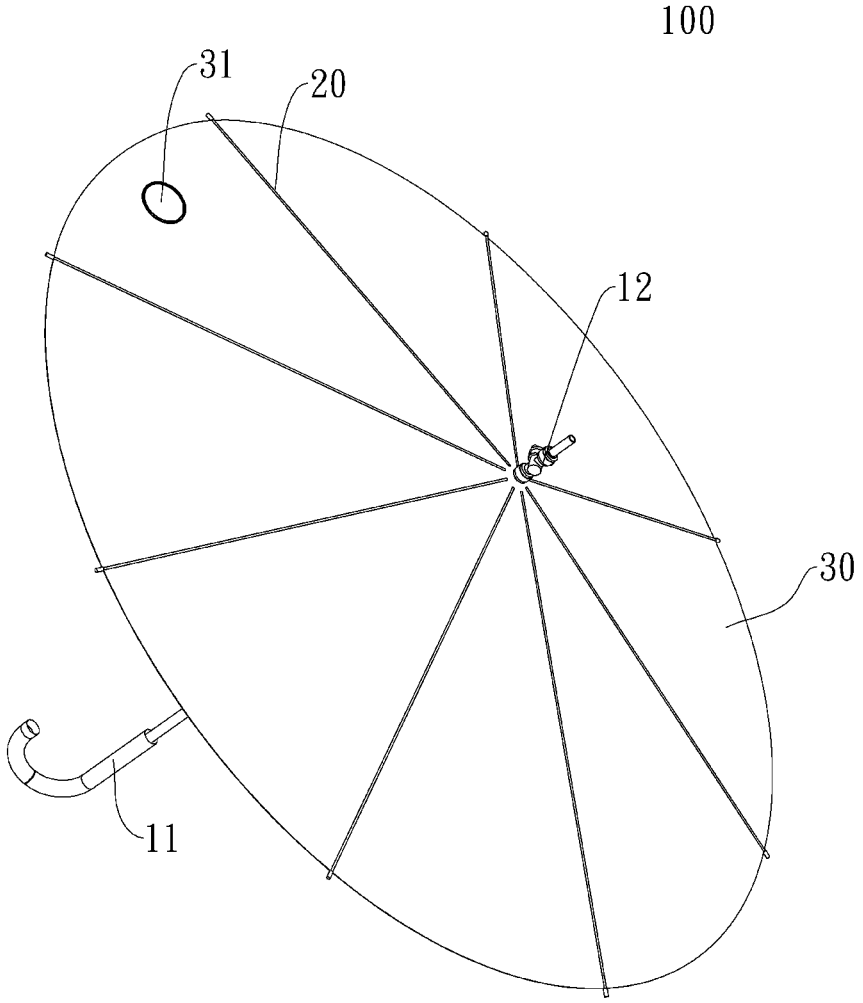
FIG. 2C is a perspective view showing, from another perspective, the umbrella having a flow-guiding device according to the present invention.

FIGS. 2A to 2C show an umbrella 100 having a flow-guiding device according to the present invention, the umbrella 100 comprising: an umbrella shaft 10, with a handle 11 disposed on one end thereof and a second control valve 12 disposed on the other end thereof; an umbrella frame 20, having a plurality of ribs disposed pivotally around the umbrella shaft 10 and extending outward radially; an umbrella cloth 30, covering the umbrella frame 20 and having an outside surface and an inside surface, the outside surface having a flow-guiding opening 31 arranged thereon; and a flow-guiding device 40, disposed on the inside surface of the umbrella cloth 30 between two adjacent ribs of the umbrella frame 20 and comprising: a flow-guiding passage 41, a plurality of first control valves 42, a flow-guiding bag 43 and a flow-guiding tube 44. The flow-guiding passage 41 is connected to the flow-guiding opening 31 and separately to the plurality of first control valves 42. The plurality of first control valves 42 are connected to the flow-guiding bag 43; by opening the plurality of first control valves 42, the fluid coming down from the flow-guiding opening 31 is directed to flow into the flow-guiding bag 43, and by closing the plurality of first control valves 42, backflow of the fluid can be prevented. One end of the flow-guiding tube 44 is connected to the flow-guiding bag 43, and the other end of the flow-guiding tube 44 is connected to the second control valve 12 on the umbrella shaft 10; by opening the second control valve 12, the fluid inside the flow-guiding bag 43 can be discharged.

In this embodiment, the umbrella shaft 10 is a hollow pole, and thus by connecting the flow-guiding tube 44 to the hollow umbrella shaft 10, fluid can be discharged from the umbrella shaft 10. The flow-guiding opening 31 and the flow-guiding passage 41 are designed to match shapes of human body parts. In this embodiment, the flow-guiding opening 31 and the flow-guiding passage 41 are round, but they may also be oval or in other shapes that match shapes of human body parts, so that the flow-guiding opening 31 and the flow-guiding passage 41 are connected and the area for urinating can be extended. The flow-guiding passage 41 is connected to the plurality of second control valves 12, which are connected to the flow-guiding bag 43 to collect the urine (not shown in the drawings).

Also, in this embodiment, the flow-guiding device 40 of the present invention is disposed on the inside surface of the umbrella cloth 30. The flow-guiding bag 43 has a tapering funnel shape, and the wider top portion of the flow-guiding bag 43 is connected to the plurality of first control valves 42. This embodiment only discloses a pair of first control valves 42; if the umbrella cloth 30 covers a larger area, more first control valves 42 may be disposed to speed up the discharge of fluid coming from the flow-guiding passage 41. The narrow bottom portion of the flow-guiding bag 43 is connected to the flow-guiding tube 44, and the tapering design facilitates the collection of urine.

Moreover, in this embodiment, the first control valves 42 may be replaced with one-way check valves, so that the user needs not manually open or close the first control valves 42 while the effect of preventing fluid backflow can be achieved. Besides, the umbrella 100 having a flow-guiding device according to the present invention further comprises a protective layer 50. The protective layer 50 is used for covering the flow-guiding device 40, so as to protect and secure the flow-guiding device 40 onto the inside surface of the umbrella cloth 30, as well as improve the outlook of the umbrella.

Figure 3:
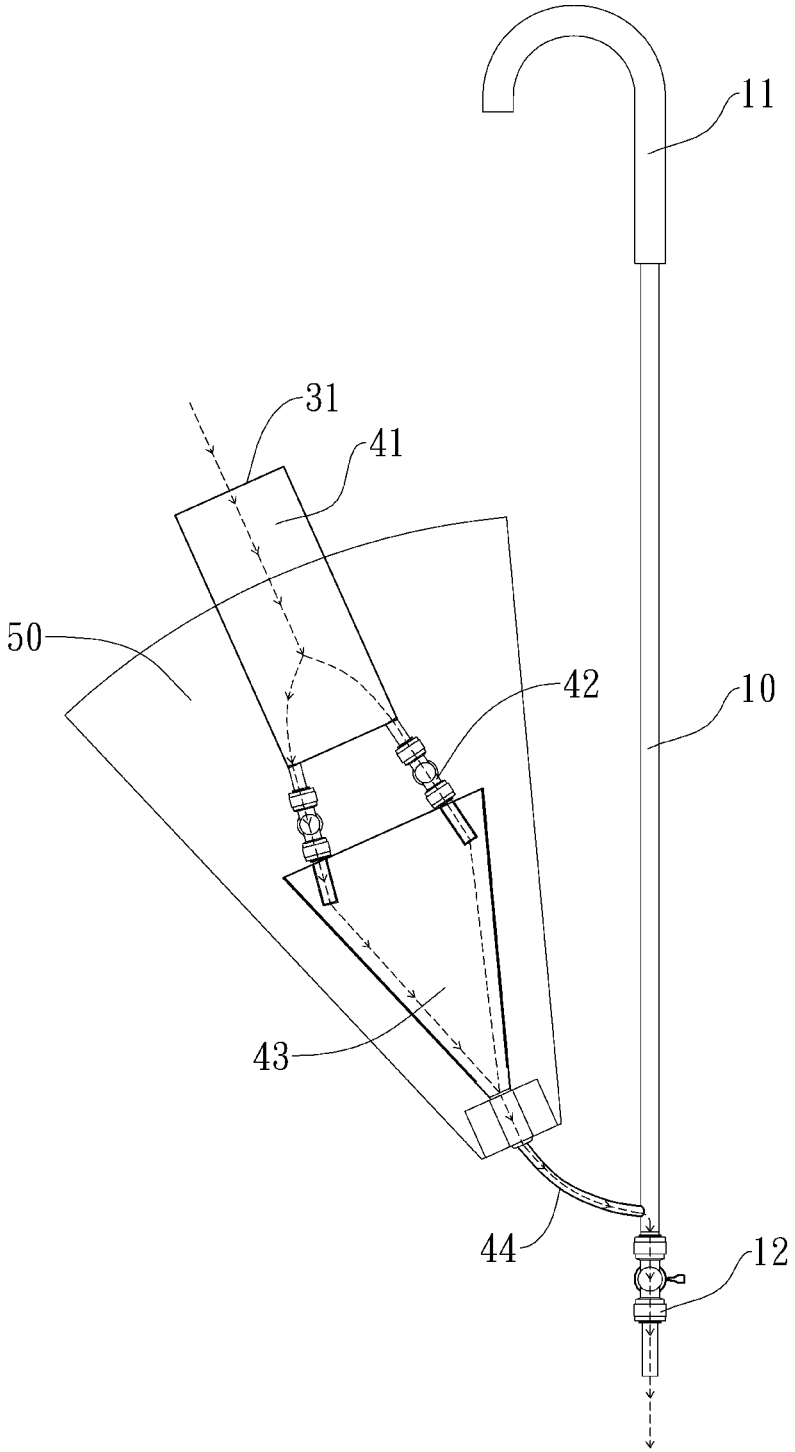
FIG. 3 is a schematic view illustrating how to use the umbrella having a flow-guiding device according to the present invention.

FIG. 3 shows a schematic view illustrating how to use the umbrella having a flow-guiding device according to the present invention. If a restroom is not available and the user intends to use the umbrella 100 having a flow-guiding device according to the present invention, the user can lean near the flow-guiding opening 31 on the outside surface of the umbrella cloth 30; the user then opens the plurality of first control valves 42 to keep the flow path between the flow-guiding passage 41 and the flow-guiding bag 43 unobstructed, so that the urine discharged from the body is directed to flow into the flow-guiding bag 43. After use, the user closes the plurality of first control valves 42 to prevent the backflow of urine. Afterwards, the user may go to a toilet, open the second control valve 12 on the umbrella shaft 10, and discharge the urine in the flow-guiding bag 43 through the flow-guiding tube 44 which connects to the hollow umbrella shaft 10, thus discharging the urine from the umbrella 100 having the flow-guiding device and finishing the use thereof.

With a design that integrates a flow-guiding device on the structure of an umbrella, the umbrella according to the present invention utilizes the shielding function of the umbrella along with the features of the flow-guiding device, and thereby allows the user to urinate conveniently in a comfortable manner when a restroom is not available.

What is claimed is:

1. An umbrella having a flow-guiding device, comprising:

an umbrella shaft, having a handle disposed on one end and a second control valve disposed on the other end;

an umbrella frame, having a plurality of ribs disposed pivotally around the umbrella shaft and extending outward radially;

an umbrella cloth, covering the umbrella frame and having an outside surface and an inside surface, the outside surface having a flow-guiding opening arranged thereon; and a flow-guiding device, being disposed on the inside surface of the umbrella cloth between two adjacent ribs of the umbrella frame and comprising: a flow-guiding passage; a plurality of first control valves; a flow-guiding bag; and a flow-guiding tube, wherein:

the flow-guiding passage is connected to the flow-guiding opening and the plurality of first control valves; the plurality of first control valves are connected to the flow-guiding bag, which is further connected to one end of the flow-guiding tube; by opening the plurality of first control valves, fluid coming down from the flow-guiding opening is directed to flow into the flow-guiding bag; by closing the plurality of first control valves, backflow of the fluid is prevented; the other end of the flow-guiding tube is connected to the second control valve on the umbrella shaft; and by opening the second control valve, the fluid inside the flow-guiding bag is discharged.

2. The umbrella having a flow-guiding device of claim 1, further comprising a protective layer, the protective layer being used for covering the flow-guiding device, so as to protect and secure the flow-guiding device onto the inside surface of the umbrella cloth and to improve the outlook of the umbrella.

3. The umbrella having a flow-guiding device of claim 1, wherein the umbrella shaft is hollow, and the flow-guiding opening and the flow-guiding passage are formed in shapes that match shapes of human body parts.

4. The umbrella having a flow-guiding device of claim 3, wherein the flow-guiding opening and the flow-guiding passage are round or oval in shape.

5. The umbrella having a flow-guiding device of claim 1, wherein the flow-guiding bag has a tapering funnel shape that is wide at the top and narrow at the bottom.

6. The umbrella having a flow-guiding device of claim 1, wherein the plurality of first control valves are one-way check valves.

* * * * *